United States Patent [19]

Evans

[11] Patent Number: 4,580,424

[45] Date of Patent: Apr. 8, 1986

[54] SINGLE LEVER, DOUBLE CHANGEABLE SAFE DEPOSIT LOCK

[75] Inventor: Walter R. Evans, Lancaster, Ky.

[73] Assignee: Sargent & Greenleaf, Inc., Nicholasville, Ky.

[21] Appl. No.: 549,969

[22] Filed: Nov. 7, 1983

[51] Int. Cl.[4] ..... E05B 25/00

[52] U.S. Cl. ..... 70/383; 70/339; 70/355

[58] Field of Search ..... 70/382–384, 70/339, 355

[56] References Cited

U.S. PATENT DOCUMENTS

| | | | |
|---|---|---|---|
| 701,231 | 5/1902 | Taylor | 70/383 |
| 953,641 | 3/1910 | Prindle | 70/384 |
| 960,421 | 6/1910 | Sibley | 70/383 |
| 972,241 | 11/1910 | Prindle | 70/339 |
| 3,127,759 | 4/1964 | Ellis et al. | 70/339 |
| 3,837,196 | 9/1974 | Gartner et al. | 70/383 X |
| 3,983,728 | 10/1976 | Phillips | 70/339 |
| 4,462,230 | 7/1984 | Evans | 70/383 |

*Primary Examiner*—Robert L. Wolfe

*Attorney, Agent, or Firm*—Mason, Fenwick & Lawrence

[57] ABSTRACT

A double changeable tumbler lever type key lock for safe deposit boxes and the like having a slidable bolt plate carrying a stack of fence members, and a stack of tumbler levers occupying positions in the locked condition to bar retraction of the fence members and bolt plate from locking position. The tumbler levers each have first and second lift edge portions and are movable responsive to a guard key and a renter's key engageable with the pair of lift edge portions of each tumbler lever to position the levers to permit retraction of the bolt to unlocking position. Mounting structure on the bolt plate supports the fence members of the stack for guided adjustment to positions corresponding to a predetermined range of key shapes and for selectively clamping the fence members in their adjusted position.

12 Claims, 15 Drawing Figures

SINGLE LEVER, DOUBLE CHANGEABLE SAFE DEPOSIT LOCK

BACKGROUND AND OBJECTS OF THE INVENTION

The present invention relates in general to key locks, and more particularly to key locks for safe deposit boxes and the like, wherein both a guard key or "prep" key and a renter's key having a proper configuration on the key bit must be inserted into the lock and rotated to effect retraction of the bolt, and wherein the lock is capable of being changed in the field for different guard or prep keys and for different renter keys.

It will be appreciated that safe deposit boxes in bank vaults and similar security installations are successively leased to different parties, to whom the lessor furnishes a renter's key adapted to open a given safe deposit box when the lock is partially operated or armed by a guard or prep key in the possession of the lessor. Often, lessees fail to return the renter's key at the expiration of their lease, or the lessee may lose the renter's key, and it becomes necessary in such cases to change the safe deposit key lock so that it can be operated by a renter's key bit having a different configuration. Also, even if the lessee returns the renter's key at the expiration of his lease, it is desirable to change the key bit configuration to which the lock is responsive whenever the lessee of the box is changed, to prevent the otherwise possible use of an unauthorized duplicate of the renter's key which may have been made before the renter's key was returned.

For this reason, certain safe deposit locks have been made in such a manner that the position of the gatings in the tumblers operated by the renter's key is changeable, so that the position of the gatings may be adjustably set to be opened by a different renter's key. The typical practice in this regard has been to provide a change key in the form of a non-round cross-section rod which is insertable into an opening in the safe deposit lock case or rear cover wall and through shaped openings in the renter's key tumblers, when the safe deposit lock has been activated by the old renter's key. The combination change key interfits into shaped openings in one of two pivoted companion tumbler sectors for each of the renter's key tumbler levers, all of which tumbler lever sectors are pivoted on a fixed tumbler post, to decouple the normally mated tumbler lever sections of each of these tumbler levers and permit them to be recoupled in a position corresponding to the configuration of the bit of a new renter's key.

It has become recognized that it is also desirable to provide for the setting of the guard key or prep key tumbler lever system in accordance with different guard key or prep key configurations (hereinafter generally referred to as the prep key), so that the prep key to be used with safe deposit locks can be changed from time to time to provide greater security or to reset the locks when the prep key is lost or when change of guard personnel occurs. Attempts to provide for changing the lock to accommodate different prep keys as well as different renter keys have generally involved use of renter's key tumbler levers which are either made up of two pivoted companion tumbler sectors which may be selectively decoupled when the lock is in a change mode to permit relative adjustment of one of the tumbler sectors with respect to the other to accommodate the configuration of the bit of the new renter's key, and also using an entirely different set of prep key tumbler levers disposed in a portion of the lock housing spaced from the renter's key tumbler levers and a plurality of independently adjustable fence members positioned relative to the prep key tumblers capable of being set to different positions in accordance with different guard key configurations. Such a construction requires a considerably larger space-consuming lock configuration and considerably increases complications and expense in the assembly of safe deposit lock units.

The present invention is directed to a double changeable safe deposit box key lock having a single set of tumbler levers operated by both a guard key and a renter key and coactive with a set of a number of slidable fences corresponding to the number of tumbler levers, as distinguished from many prior safe deposit box locks of the tumbler lever types which employ two sets of tumbler levers, one set for operation by the guard key and another set for operation by the renter key. The single lever function is worked by both the guard key and the renter key, the guard key setting the pivot point of the tumbler levers, and the renter key setting the slidable fences when the lock is in a change condition. A change screw is loosened at the change condition to enable the slidable fences to move in response to the key bitting on the renter key, and after setting of the position of the slidable fences by setting of the tumbler lever positions responsive to a renter key, the change screw is tightened to hold the fences in the position to which they are set by the levers and bitting on the new renter key and also responsive to the guard key setting of the pivot points of the levers.

An object of the present invention is the provision of a novel construction of a tumbler lever lock for safe deposit boxes and the like, having a single set of tumbler levers and a single set of a corresponding number of slidable fences, wherein the pivot points of the tumbler levers are set by a guard key and the tumblers levers are properly positioned by the bitting on the renter key so as to align gate recesses and edges of the tumbler levers confronting fence formations on the slidslidable fences to enable movement of the lock to unlocking position. Simplification is achieved by enabling both renter key change and guard key change of the tumbler lever positions by one change screw associated with the set of slidable fences, and either both the renter key and the guard key or one of the renter or guard keys can be changed as desired by use of the single change screw.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
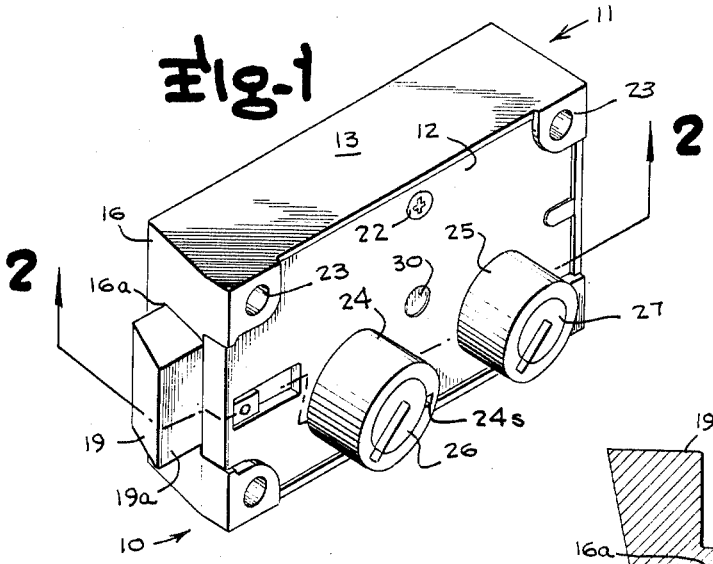
FIG. 1 is a front perspective view of a changeable safe deposit box lock of the tumbler lever type embodying the present invention.

Referring to the drawings, wherein like reference characters designate corresponding parts throughout the several figures, the key operable single lever, double changeable safe deposit box lock of the present invention in indicated generally by the reference character 10, and comprises a lock case 11 and a cover plate 12 assembled by screws with the case to form a box-like enclosure for the lock mechanism. In accordance with conventional practice, the lock case 11 is a generally rectangular housing in the form of a forwardly opening box-like structure to be forwardly closed by the cover plate 12, and comprises parallel top and bottom walls 13, 14, a rear wall 15, and end walls 16 and 17. The end wall 16 has an opening therethrough through which projects a locking bolt formation 19 which is integral with and extends from the elongated bolt plate 20. The front cover plate 12 includes a front panel or wall 21 having screw holes for receiving screws 22 therethrough to be threaded into tapped formations on the top and bottom walls 13, 14, for example as indicated at 13*a* in FIG. 3 for assembling the cover plate to the case 11. The lock case 11 also includes through holes 23 adjacent the four corners through which mounting screws can extend into tapped openings in the safe deposit box door or other security closure member on which the lock is to be mounted.

The cover plate 12 has a pair of forwardly projecting horns or annular bosses 24, 25, one of which serves as the horn for the renter's key, and the other which serves as the horn for the guard or prep key. In the illustrated embodiment, the horn 24 is the renter's key horn and the horn 25 is the guard key horn. These horns 24 and 25 serve as outwardly surrounding tubular bearings for hubs or plugs, indicated at 26 and 27, for the renter's key and guard key respectively, and extend through customary circular openings provided therefor in the door of the conventional safe deposit box compartment or chamber. Mounting screws, in the usual installation, are fitted through the corner holes 23 and project into tapped openings in the safe deposit compartment door to mount the assembled case and cover plate against the inner surface of the door.

The bolt plate member 20 includes the usual heavy bolt formation 19 in the form of a thick, generally rectangular block which projects from the lock case through the wall 16 into a conventional keeper recess in the locking or projecting position of the bolt, and includes an integral thinner bolt plate portion 28 extending rearwardly through the major portion of the lock mechanism chamber and includes an elongated slot 29 which receives a stationary guide post 30 extending forwardly from the rear wall of the lock case. The edges of the slot 29 bounding the fixed guide post 30 and the upper and lower edges of the opening 16*a* in case wall 16 receiving the bolt formation 19 coact to guide the bolt plate member in proper alignment along a horizontal rectilinear path, assuming the usual installation orientation of the lock, for rectilinear reciprocative movement between its projected, locked position and its retracted, unlocked position. The thinner bolt plate portion 28 of the bolt plate member 20 has appropriately shaped downwardly opening recesses to receive the hubs or generally cylindrical arbor portions of the plugs 26, 27 the renter's key plug 26 being a 2-part assembly having a front plug member 26*p* journaled in the horn 24 having a keyway or slot therein and a shaft portion 26*s* coupled against relative rotation with plug member 26*p*, also having a keyway and a driving tang or projection 26*a* interfitted in shaped recess 28*a* of the bolt plate 20.

In the illustrated embodiment, a single stack or set of tumbler levers are provided, indicated generally by the reference character 31, each of the levers being of a distorted generally T-shaped configuration having a shortened vertical leg, providing a horizontally elongated body having a vertically elongated slot 32 in the mid-portion thereof receiving the post 30 projecting from the rear wall of the case. The opposite ends of the tumbler levers 31 define a gated end 31*a* and a guard key activating tail end 31*b*. The gated end 31*a* has a fence receiving gate 33 therein of generally teardrop configuration opening through oppositely inclined edge portions 34*a*, 34*b* of the gated end 31*a* which converge forwardly toward the gates 33, the gates 33 and the adjacent edges 34*a*, 34*b* being disposed in confronting relation to a pack of selectively adjustable slide fence members 35. The tumbler levers 31 have spring wire members 36 fixed in the guard key actuated tail end portions 31*b* of the tumbler levers, for example by seating an end portion of each spring wire member 36 in an inclined narrow cut in the side of the tumbler lever tail end portion 31*b* near the rearmost end thereof which is stamped or deformed to substantially closed condition at the side of the lever through which the narrow cut opens to fix the spring wire therein. The spring wire extends in a forwardly and upwardly inclined path to bear against the top wall or a formation such as the screw receiving boss 13*a*, of the lock case to resiliently bias the tumbler levers 31 about the post 30 to assume a rest position wherein lift edge surfaces 34*d* of the tail end portion 31*b* of the tumbler levers abut the smaller diameter rearwardly projecting cylindrical arbor or shaft portion 27*a* of the guard key plug 27.

The slide fence members 35 are generally L-shaped plates having a vertically elongated, generally rectangular thicker main body portion 39 and a rearwardly projecting, fence forming foot portion 40 which projects horizontally in the direction of the gated portions of the tumbler levers 31 to be received in the gates 33 when the proper keys are inserted in the lock and shifted to unlocking position. The main body portion 39 of the fence members 35 has a vertically elongated slot 41 therein to receive a clamp screw 42, and are restrained in vertical alignment for sliding movement only along a vertical axis perpendicular to the horizontal reciprocating axis of the bolt member by a clamping bracket 43 having a pair of parallel vertical sides 44 which embrace and guide the opposite vertical edges of the main body portions 39 of the fence members 35 and one of which extends rearwardly into a slot 28*s* therefor in the bolt plate portion 28 of the bolt plate member 20. The clamping bracket 43 is of substantially U-shaped configuration in top plan view and the forwardmost wall 45 thereof includes a thickened portion 45*a* having a threaded opening therethrough into which the shank portion of the clamp screw 42 extends. In the embodiment illustrated, the clamp screw 42 is an Allen head screw, whose shank portion extends through and is journaled in an appropriately sized opening in the bolt plate 28 and has an enlarged head 42*a* movable with the bolt in a horizontally elongated shaped cavity 46*a* in the rear wall 15 of the lock case, arranged to expose the clamp screw head 42*a* to receive an Allen head wrench or similar manipulating tool to adjust the clamp screw 42 to clamping and release positions relative to the fence members in the clamping bracket 43 when the bolt plate reaches its change position and unlocked position as later described.

In the normal condition of the lock, the clamp assembly formed of the clamp screw 42 and clamping bracket 43 for the pack of fence members 35 will be in tightened clamping position holding the vertically elongated rectangular main body portions 39 at vertical positions such that the foot-like fence formations 40 thereof are properly disposed to be received in the gates of the associated tumbler levers 31 when the tumbler levers are adjusted angularly about the posts 30 by the proper renter's key and guard key for which the slide fence members 35 have been previously adjusted. When the lock is in the locked condition, the bolt plate member 20 is in the projected position of FIG. 4 wherein the fence formations 40 of the fence members are withdrawn from the gates 33 of the tumbler levers 31 and the lower lift surface edges 34*c* of the portions of the fence levers adjacent the gated end 31*a* are biased by the spring wire members 36 against the surface of the generally U-shaped arbor or shaft portion 26*s* of the renter's key plug 26, and the mounting post 30 bearing against the uppermost end portions of the vertical slots 32 in the tumbler levers.

Figure 4A:
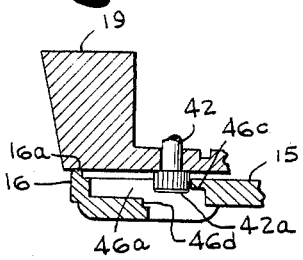
FIGS. 3A, 4A, 5A, and 6A are fragmentary section views along line 3A—3A of FIG. 3, showing the clamp screw head position for FIGS. 3, 4, 5, and 6 positions for the bolt plate.
Figure 3A:
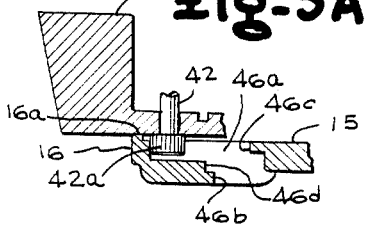
Figure 2:
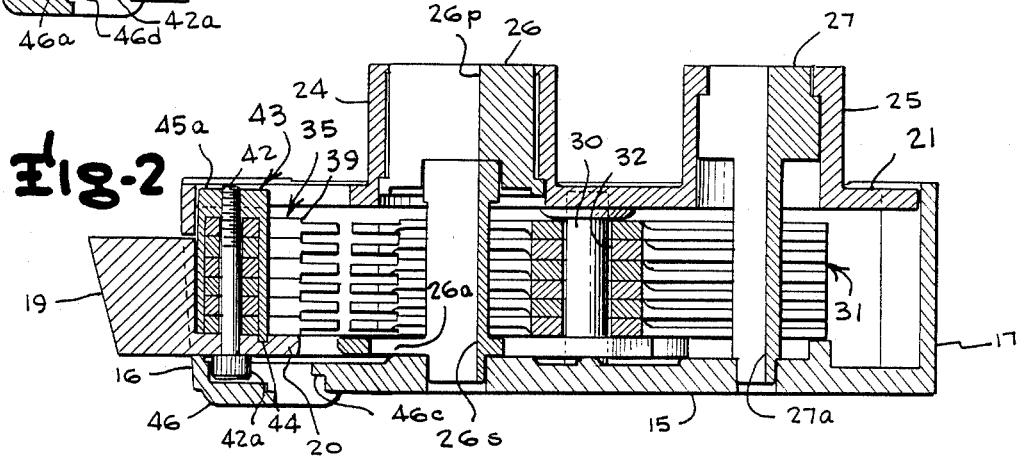
FIG. 2 is a horizontal longitudinal section view thereof taken along the line 2—2 of FIG. 1.
Figure 4:
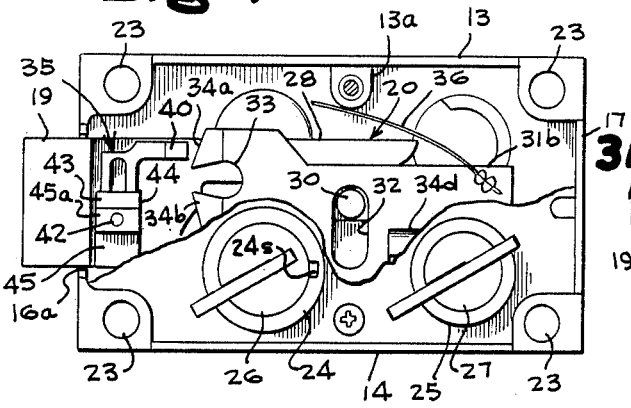
FIG. 4 is a front view similar to FIG. 3, but showing the components in locked position.
Figure 3:
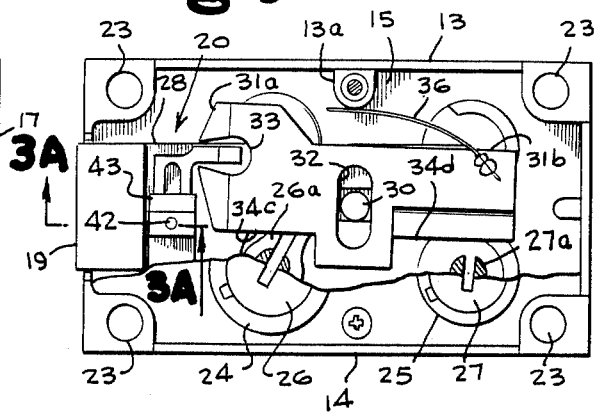
FIG. 3 is a front view with parts broken away, showing the stack of key operated tumbler levers positioned by proper keys for retraction of the bolt, and with the bolt retracted into unlocked position.

In normal operation to unlock the lock, the guard key is first inserted in the keyway of the guard key plug 27 and rotated clockwise, as viewed in FIGS. 4 and 3, to the unlocking position illustrated in FIG. 3, during which the bitting of the guard key engages the lift edges 34*d* of the tail end portions 31*b* of the tumbler levers and establish the pivot points for the tail end portions 31*b* of the tumbler levers. The appropriate renter key is then inserted into the renter key plug 26 and rotated in a clockwise direction as viewed in FIGS. 4 and 3 to the unlocking position shown in FIG. 3, bringing the bitting on the renter's key into engagement with the lift edges 34*c* of the tumbler levers and pivoting the tumbler levers about the contact points of the tail end portions 31*b* with the guard key to adjust the vertical positions of the gates 33 in the tumbler levers so as to be horizontally aligned in receiving position relative to the fence formations 40 of the fence members 35. Immediately after the renter's key positions the fence lever gates in proper alignment with the fence formations to receive the latter, the driving cam projection 26*a* of the driving cam portion 26*s* engages the shoulder 28*b* the shaped opening 28*a* of the bolt plate portion 28 to drive the bolt plate to the retracted position shown in FIG. 3 during the remainder of rotation of the renter's key to the final unlocking position of FIG. 3.

Figure 5:
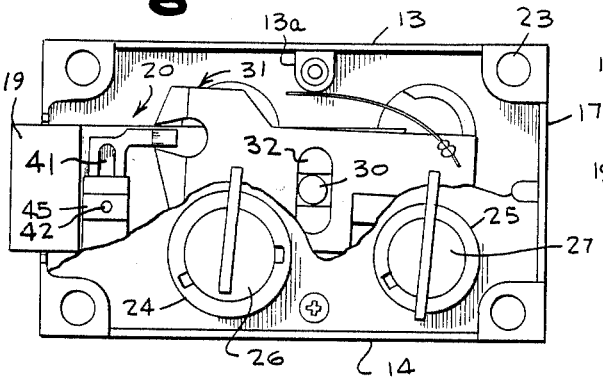
FIG. 5 is a front view similar to FIG. 3, but showing the components in change position for adjusting the tumblers to a new key.
Figure 6:
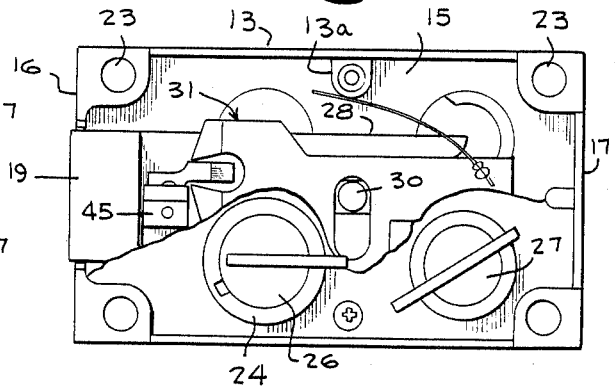
FIG. 6 is a front view similar to FIG. 3, but showing the components in set-up position for withdrawal of old renter keys and insertion of new ones.
Figure 5A:
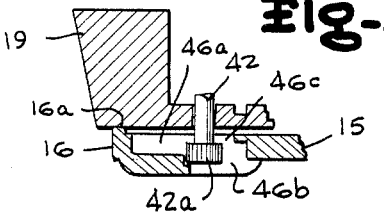
Figure 6A:
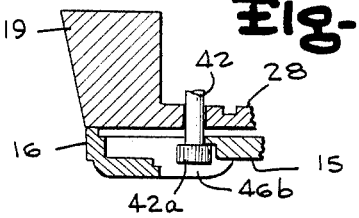

When it is desired to change the renter's key for the safe deposit box lock, the proper guard key is inserted in the keyway 27*a* of the guard key plug 27 and is rotated to the approximately 12:30 position shown in FIG. 3 to position to the bitting on the key to establish the proper pivot points for the lift edges 34*c* of the tail end portions 31*b* of the tumbler levers 31. The old renter key for which the lock is presently set is then inserted in the keyway 26*b* of the renter's key plug 26 and rotated clockwise to the change position shown in FIG. 5, wherein the head 42*a* of the clamp screw 42 is exposed through the opening 46*b* of the cavity formation 46*a* in the rear wall 15, but is not moved so far as to abut or jam against the shelf formation 46*c* adjacent the rear end of the cavity 46*a*. A change wrench, such as an Allen wrench, is then inserted through the tool opening 46*b* into the socket of the clamp screw 42 and rotated through the appropriate range to move the enlarged head 42*a* rearwardly to a position where it will rearwardly clear the shelf formation 46*c*. This action also loosens the set of fence members 35 so that they are free to slide vertically to different positions from their present setting, although they do not move at this point because their relative vertical positions are set by the fence formations 40 thereof being disposed in the fence lever gates 33. However, since the head 42*a* of the clamp screw 42 is now clear of the abutment shelf 46*c*, the renter's key and the driver cam projection 26*a* associated therewith are free to move a further distance in a clockwise direction, further retracting the bolt plate member 20 therewith, until the renter's key and renter key plug 26 reach the setup position of FIG. 6, where the renter's key aligns with the change key slot 24*s* in the horn 24, permitting withdrawal of the old renter key from the key plug 26 while the fence members 39 are still loose. A new renter's key is then inserted in the keyway of the plug 26 and rotated back to the change position where the clamp screw head 42*a* abuts the shoulder 46*d* in the rearwardly enlarged portion of the cavity 46*a*. The Allen wrench is then reinserted in the head of the clamp screw 42 and rotated to tighten the clamp screw back to tightened condition shown in FIGS. 3A and 4A where it is positioned forwardly at a location to clear the shoulder 46*d* of the cavity 46*a* and permit the renter key to be returned to the initial locked position of the renter key horn 26 where it is aligned with the slot 24*b* of the horn 24 allowing key withdrawal from the lock.

The procedure for changing the guard key is similar, in that the guard key and renter's key are inserted in the appropriate plugs 26 and 27 and rotated to the stop position where the clamp screw head 42*a* abuts the shelf 46*c*. The change wrench is then inserted through the opening 46*b* into the head of the clamp screw 42 and rotated to release the fence members 39. The guard key is then rotated back to locked position where it is aligned with the entry slot 25*d* of the horn 25 and is withdrawn from the plug 27, the new guard key is inserted and rotated to unlocked position, the clamp screw 42 is then tightened, and the renter key is rotated to the locked position and removed, and the guard key then removed.

Figure 8A:
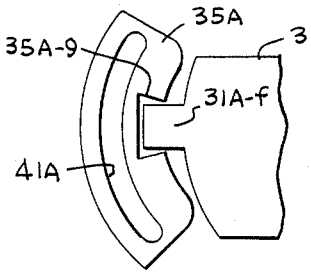
FIGS. 8A, 8B, 8C, and 8D illustrate fragmentary elevational portions of variations of the fence member configuration and the confronting portions of the coacting tumbler level portions for various modifications of the fence member and tumbler lever operating in accordance with the present invention.
Figure 8B:
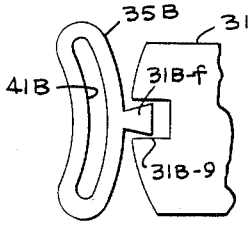
Figure 8C:
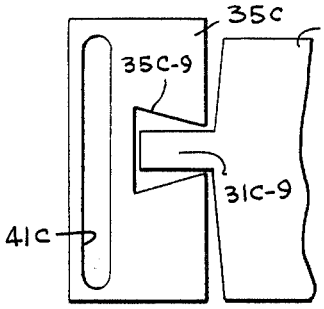
Figure 8D:
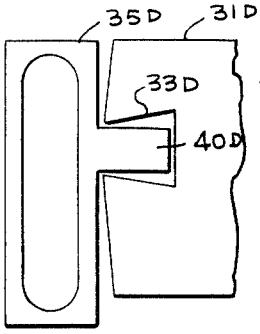
Figure 7:
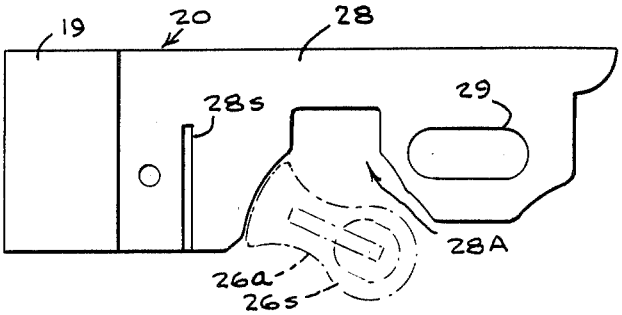
FIG. 7 is an elevational view of the bolt plate member.

FIGS. 8A, 8B, 8C, and 8D show various modifications of the configuration of the slide fence members corresponding to the member 35 of the previously described embodiment and the confronting edge portions of the tumbler levers corresponding to the tumbler levers 31 of the preceding embodiment, with the fence members of these variations indicated by the reference character 35 followed by the alphabetical character designating that figure and the adjacent portions of the tumbler lever indicated by the reference character 31 followed by the alphabetical character corresponding to the figure. It will be noted that in the case of FIGS. 8A, 8B and 8C, the slide fence members 35*a* and 35*c* are provided with corresponding slots 41A, 41B and 41C coacting with suitably shaped clamping brackets like the clamping bracket 43 with a clamp screw 42 extending therethrough, and have a gate recess, as indicated at 35A–*g* and 35C–*g* in FIGS. 8A and 8C and have a projecting foot 35B–*f* in the case of FIG. 8B, of truncated triangular configuration, coacting with projecting male fence foot formations 31A–*f* 31C –*f* in FIGS. 8A and 8C projecting from the tumbler levers, or coacting with gate 31B–*g* in the case of FIG. 8B. In FIG. 8B, the foot formation 40D is provided on the slide fence member 35D but is located at an intermediate level between the upper and lower ends of the main body portions and coacts with a truncated triangular shaped gating recess 33D in the tumbler levers 31D. The operation of these variations will be well understood from the description of the preferred embodiment illustrated in FIGS. 3–6 and 3A–6A.

In the preferred embodiment, the tumbler levers are coined on opposite sides along the key lift edges 34*c* and 34*d*, to allow the key levers to fit scissor lock key bitting. This allows one tumbler lever to be used in place of two tumbler levers on scissor-type locks. Also, if desired, the lock construction can be set up for single key operation with a stationary arbor simply replacing the guard key horn 27 and eliminating the guard key horn and guard key plug, so that no guard key is used during set up changing to set the fence members for a particular renter's key.

I claim:

1. A double changeable tumbler lever type key lock for safe deposit boxes and the like comprising a lock case defining a generally box-like enclosure having front and rear vertical walls, a bolt plate slidably movable along a slide axis adjacent one of said walls between projected locking and retracted unlocking positions having a stack of fence members carried thereon each having a elongated body portion movable along an adjustment path generally transverse to said slide axis, a stack of tumbler levers occupying position in the locked condition of the lock to bar retraction of said fence members and said bolt plate from a projected locking position when in the locking position, the fence members and tumbler levers forming two sets of intercept members having fence and gate companion interfitting means thereon including peripheral gating recesses on one of said sets and protruding foot formations on the other of said sets, said tumbler levers being movable responsive to a pair of keys to adjust the interfitting means thereof to accommodate the companaion interfitting means of said fence members to permit retraction of the bolt to unlocking position, a stationary tumbler lever post extending from a wall of the case extending through slots in the tumbler levers permitting relative displacement and arcuate movement of the tumbler levers relative thereto, the tumbler levers being of generally T-shaped configuration providing a short vertical foot portion and a generally horizontal elongated cross-arm portion having arms projecting oppositely from the foot portion with downwardly facing substantially linearly alined lower edges defining first and second straight lift edges spaced toward opposite ends of the case from said post, said slot being vertically elongated and extending into said foot portion, a first rotatable key plug for insertion of a guard key therein into engagement with said first lift edge of said tumblers for establishing pivot points for the tumbler levers when engaged by a guard key, a second rotatable key plug for insertion of a renter's key therein into engagement with said second lift edge of the tumble lever lift edges for adjusting the tumbler levers to align their interfitting means with the interfitting means of the fence members for unlocking retraction of the bolt, the bolt plate having a shaped opening therein, a driving cam associated with said second key plug to be rotated by the renter's key and having a projection for moving the bolt plate between said locking and unlocking positions, means extending from the bolt plate supporting the fence members of the stack for guided adjustment along said adjustment path to positions corresponding to a predetermined range of key shapes and clamping means associated therewith for selectively clamping the fence members in their adjusted position and releasing them for movement responsive to key adjustment of the tumbler levers.

2. A changeable combination key lock as defined in claim 1, wherein said fence clamping means comprises a clamping member having a portion overlapping the face of the stack of fence members opposite said bolt plate and a clamping screw coupled to the clamping member and the bolt plate to clamp the fence members in fixed positions against the bolt plate when the screw is in tightened fence clamping position, one of the vertical walls of said case having means receiving a head portion of said clamping screw accommodating movement of the bolt plate and head through a predetermined first range from the locking to unlocking positions and having a stop shelf formation located to abut the clamping screw head at the unlocking position of the bolt plate, the stop shelf and clamping screw head being shaped to accommodate a short extent of additional retracting movement of the bolt plate to a key change position when the clamping screw is rotated to a fence releasing position and the bolt plate occupies the unlocking position, the bolt plate having an opening shaped to accommodate key rotation of the renter's key to a key change position allowing retraction of the renter's key from the key plug therefor with the fence members released for adjustment along their adjustment axes and allowing insertion of a new key into the renter's key plug to adjust the tumbler levers and the fence members interfitted therein to new positions corresponding to the new key configuration.

3. A changeable combination key lock as defined in claim 2, wherein said rear wall has a forwardly facing recess therein accommodating said clamping screw head therein throughout the range of movement of the screw head with the bolt plate between locking and unlocking positions with the clamping screw head either in clamping position or fence releasing position, and said rear wall having an opening therethrough communicating with said recess and aligned with said clamping screw head when the bolt plate is in the unlocking position to receive a tool therethrough for rotating the clamping screw to clamping and release positions.

4. A changeable combination key lock as defined in claim 3, wherein said rear wall has a rearward extension including said recess for the clamping screw head and having said tool opening therethrough.

5. A changeable combination key lock as defined in claim 1, wherein said body portions of said fence members have guide surfaces elongated in the direction along which said guide path extends and said clamping means include abutment guide surfaces elongated in a corresponding direction engaging the guide surfaces of the fence members for guided adjustment of the fence members through their range of positions and said clamping means includes an internally threaded portion having a fixed positional relationship with said abutment guide surfaces threadedly coupled with threaded portions of said clamping screw.

6. A changeable combination key lock as defined in claim 2, wherein said body portions of said fence members have guide surfaces elongated in the direction along which said guide path extends and said clamping means include abutment guide surfaces elongated in a corresponding direction engaging the guide surfaces of the fence members for guided adjustment of the fence members through their range of positions and said clamping means includes an internally threaded portion having a fixed positional relationship with said abutment guide surfaces threadedly coupled with threaded portions of said clamping screw.

7. A changeable combination key lock as defined in claim 3, wherein said body portions of said fence members have guide surfaces elongated in the direction along which said guide path extends and said clamping means include abutment guide surfaces elongated in a corresponding direction engaging the guide surfaces of the fence members for guided adjustment of the fence members through their range of positions and said clamping means includes an internally threaded portion having a fixed positional relationship with said abutment guide surfaces threadedly coupled with threaded portions of said clamping screw.

8. A changeable combination key lock as defined in claim 4, wherein said body portions of said fence members have guide surfaces elongated in the direction along which said guide path extends and said clamping means include abutment guide surfaces elongated in a corresponding direction engaging the guide surfaces of the fence members for guided adjustment of the fence members through their range of positions and said clamping means includes an internally threaded portion having a fixed positional relationship with said abutment guide surfaces threadedly coupled with threaded portions of said clamping screw.

9. A changeable combination key lock as defined in claim 1, wherein said fence members are of L-shaped configuration having a vertical leg forming said body portion and a foot portion extending horizontally from the lower end of said body portion toward the gated peripheries of said tumbler levers, the gates of the tumbler levers being scrambled out of alignment with said foot portions in their locked condition and being key positioned to align their gates to receive said foot portions interfitted therein in the unlocked condition of the lock.

10. A changeable combination key lock as defined in claim 2, wherein said fence members are of L-shaped configuration having a vertical leg forming said body portion and a foot portion extending horizontally from the lower end of said body portion toward the gated peripheries of said tumbler levers, the gates of the tumbler levers being scrambled out of alignment with said foot portions in their locked condition and being key positioned to align their gates to receive said foot portions interfitted therein in the unlocked condition of the lock.

11. A changeable combination key lock as defined in claim 3, wherein said fence members are of L-shaped configuration having a vertical leg forming said body portion and a foot portion extending horizontally from the lower end of said body portion toward the gated peripheries of said tumbler levers, the gates of the tumbler levers being scrambled out of alignment with said foot portions in their locked condition and being key positioned to align their gates to receive said foot portions interfitted therein in the unlocked condition of the lock.

12. A changeable combination key lock as defined in claim 4, wherein said fence members are of L-shaped configuration having a vertical leg forming said body portion and a foot portion extending horizontally from the lower end of said body portion toward the gated peripheries of said tumbler levers, the gates of the tumbler levers being scrambled out of alignment with said foot portions in their locked condition and being key positioned to align their gates to receive said foot portions interfitted therein in the unlocked condition of the lock.

* * * * *